US008628903B2

(12) United States Patent
Maehata et al.

(10) Patent No.: US 8,628,903 B2
(45) Date of Patent: Jan. 14, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Hideo Maehata, Kanagawa (JP); Fumiaki Mera, Kanagawa (JP); Kousaku Yoshimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 83 days.

(21) Appl. No.: 13/361,323

(22) Filed: Jan. 30, 2012

(65) Prior Publication Data

US 2013/0017481 A1 Jan. 17, 2013

(30) Foreign Application Priority Data

Jul. 15, 2011 (JP) ..... 2011-156776

(51) Int. Cl.
*G03G 9/08* (2006.01)

(52) U.S. Cl.
USPC ..... 430/109.4; 399/252

(58) Field of Classification Search
USPC ..... 430/109.4; 399/252
See application file for complete search history.

(56) References Cited

U.S. PATENT DOCUMENTS

| | | | | |
|---|---|---|---|---|
| 4,096,294 | A * | 6/1978 | Pacansky | 427/197 |
| 4,569,896 | A | 2/1986 | Perez et al. | |
| 5,147,750 | A | 9/1992 | Nakanishi | |
| 5,422,217 | A | 6/1995 | Ueyama et al. | |
| 5,750,301 | A | 5/1998 | Funato et al. | |
| 7,297,455 | B2 * | 11/2007 | Fujikawa et al. | 430/45.1 |

FOREIGN PATENT DOCUMENTS

| | | |
|---|---|---|
| JP | A-61-91668 | 5/1986 |
| JP | A-03-015079 | 1/1991 |
| JP | A-03-200157 | 9/1991 |
| JP | A-04-100056 | 4/1992 |
| JP | A-04-250462 | 9/1992 |
| JP | A-05-006028 | 1/1993 |
| JP | A-06-202375 | 7/1994 |
| JP | A-06-258868 | 9/1994 |
| JP | A-08-076413 | 3/1996 |
| JP | A-2000-147839 | 5/2000 |

* cited by examiner

*Primary Examiner* — Mark A Chapman
(74) *Attorney, Agent, or Firm* — Oliff & Berridge, PLC

(57) ABSTRACT

An electrostatic charge image developing toner includes: a polyester resin containing a graft copolymer, the graft copolymer being formed with a polyester skeleton as a main chain and block copolymers containing a styrene-based polymer block and a crystalline acrylate-based polymer block. The styrene-based polymer block is grafted onto the polyester skeleton.

15 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2011-156776 filed Jul. 15, 2011.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

In recent years, there is a widespread use of image forming apparatuses mainly including printers and copiers, and there is also a widespread use of techniques related to various elements of image forming apparatuses. Among image forming apparatuses, there are image forming apparatuses employing an electrophotographic system in which in many cases, a photoreceptor (image holding member) is charged using a charging device and an electrostatic latent image having a potential different from the surrounding potential is formed on the charged photoreceptor to form a pattern to be printed. The electrostatic latent image formed in this manner is developed by a toner, and then is finally transferred onto a recording medium such as a recording sheet.

SUMMARY

According to an aspect of the invention, there is provided an electrostatic charge image developing toner including: a polyester resin containing a graft copolymer, the graft copolymer being formed with a polyester skeleton as a main chain and block copolymers containing a styrene-based polymer block and a crystalline acrylate-based polymer block, in which the styrene-based polymer block is grafted onto the polyester skeleton.

BRIEF DESCRIPTION OF THE DRAWINGS

Exemplary embodiments of the present invention will be described in detail based on the following figures, wherein.

DETAILED DESCRIPTION

Figure 1:
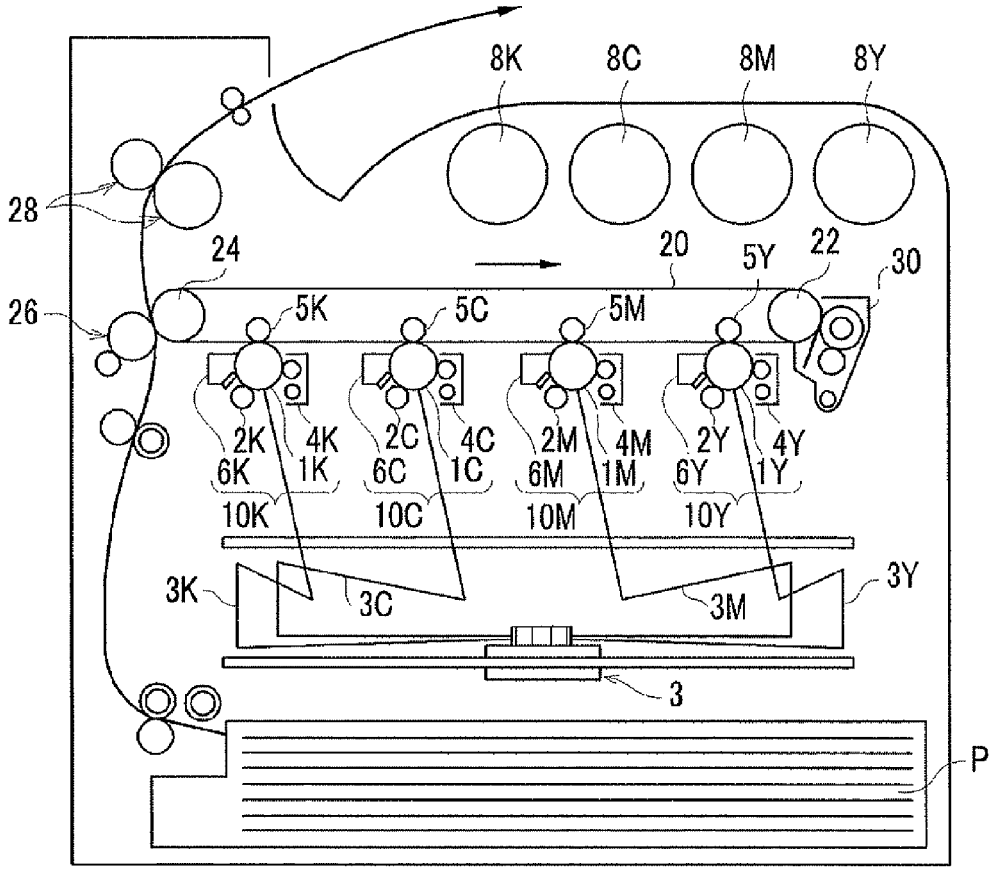
FIG. 1 is a diagram schematically showing the configuration of an example of an image forming apparatus according to an exemplary embodiment.

Hereinafter, an exemplary embodiment of the invention will be described in detail.

(Electrostatic Charge Image Developing Toner)

An electrostatic charge image developing toner (hereinafter, referred to as "toner" in some cases) according to this exemplary embodiment contains a polyester resin.

The polyester resin is constituted by a graft copolymer of a polyester skeleton as a main chain and a block copolymer as a side chain grafted onto the polyester skeleton.

The block copolymer is a block copolymer of a styrene-based polymer block and a crystalline acrylate-based polymer block.

However, in the block copolymer, the styrene-based polymer block is grafted onto the polyester skeleton.

Since the toner according to this exemplary embodiment has the above-described configuration, both the excellent strength and charge stability are obtained.

The reason for this is not clear. However, it is inferred that it is due to the effect caused by finer dispersion of the crystalline structure by grafting crystalline acrylate having a high resistance value onto a polyester main chain having an excellent resin strength and by using the graft chain as a styrene block-crystalline acrylate block copolymer in which the crystalline acrylate block is introduced to a main chain polyester via a styrene block.

From the above-described reason, it is thought that the toner according to this exemplary embodiment is excellent in fixability at lower temperatures, heat storage property, strength, and charge stability.

That is, it is thought that in the toner according to this exemplary embodiment, the low-temperature fixability (for example, fixing at from 100° C. to 120° C. (minimum fixing temperature)) is also realized in a state in which all of the strength, the charge stability and the heat storage property are excellent.

In addition, by applying the toner according to this exemplary embodiment to image forming apparatus and method, and the like (electrostatic charge image developer, toner cartridge, process cartridge), an image which is excellent in the image strength and image preservability and in which image defects resulting from a deterioration in charge stability are suppressed is obtained.

Hereinafter, the configuration of the toner according to this exemplary embodiment will be described in detail.

The toner according to this exemplary embodiment has toner particles, and if necessary, an external additive.

First, the toner particles will be described.

The toner particles contain, for example, a polyester resin as a binder resin, and if necessary, a colorant, a release agent and other additives.

The polyester resin will be described.

The polyester resin is constituted by a graft copolymer of a polyester skeleton as a main chain and a block copolymer as a side chain grafted onto the polyester skeleton.

Specifically, the polyester resin is preferably, for example, a graft polymer in which a polyester skeleton having an unsaturated polyester component serves as a main chain and a block copolymer is grafted onto the unsaturated polyester component.

The polyester skeleton is, for example, a polyester skeleton having an unsaturated polyester component. Specifically, for example, the polyester skeleton is a condensation polymer of polyvalent carboxylic acid and polyol and preferably uses a monomer having an unsaturated group (for example, vinyl group) that is an unsaturated polyester component as at least one of the polyvalent carboxylic acid and the polyol.

Particularly, the polyester skeleton is preferably a condensation polymer of polyol and polyvalent carboxylic acid having an unsaturated group (for example, vinyl group), and more preferably a condensation polymer (that is, linear polyester skeleton) of divalent alcohol and divalent carboxylic acid having an unsaturated group (for example, vinyl group).

Examples of the divalent carboxylic acid having an unsaturated group (for example, vinyl group) include fumaric acid, maleic acid, maleic anhydride, citraconic acid, mesaconic acid, 2-pentendioic acid, methylenesuccinic acid, and lower alkyl esters thereof (carbon number of 1 to 5).

These polyvalent carboxylic acids may be used singly or in combination of two or more kinds.

Examples of the divalent alcohol include bisphenol hydrogenated bisphenol A, ethylene oxide and/or propylene oxide adduct of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, neopentyl glycol and the like.

Examples of the tri- or higher-valent alcohol include glycerin, trimethylol ethane, trimethylol propane, pentaerythritol and the like.

In addition to the polyol, if necessary, monovalent acids such as acetic acid and benzoic acid and monovalent alcohols such as cyclohexanol and benzyl alcohol may also be used in combination for the purpose of adjusting the acid value and the hydroxyl value.

These polyols may be used singly or in combination of two or more kinds.

Meanwhile, the block copolymer is a block copolymer of a styrene-based polymer block and a crystalline acrylate-based polymer block. In the block copolymer, the styrene-based polymer block is grafted onto the polyester skeleton.

The styrene-based polymer block is constituted by, for example, a polymer of a styrene-based monomer.

Examples of the styrene-based monomer include styrene, alkyl-substituted styrene (for example, α-methylstyrene, vinylnaphthalene, 2-methylstyere, 3-methylstyere, 4-methylstyere, 2-ethylstyrene, 3-ethylstyrene, 4-ethylstyrene and the like), halogen-substituted styrene (for example, 2-chlorostyrene, 3-chlorostyrene, 4-chlorostyrene and the like), divinylbenzene and the like.

Among them, styrene is preferably used.

The styrene-based polymer block may be constituted by, for example, a copolymer of a styrene-based monomer and other monomers.

Examples of the other monomers include acrylic acid (AA), methacrylic acid, maleic acid, fumaric acid, itaconic acid and the like.

The mass ratio (other monomers/whole styrene-based block) of the other monomers is preferably in the range of from 0.1% to 3%.

The crystalline acrylate-based polymer block is constituted by, for example, a polymer of an acrylate-based monomer.

Here, from the point of view of low-temperature fixability, the crystalline acrylate-based polymer block is crystalline, and from the point of view of toner strength and heat storage property, the crystalline acrylate-based polymer block has a characteristic of the melting temperature being 37° C. or higher (preferably from 45° C. to 80° C.).

Examples of the confirmation that the crystalline acrylate-based polymer block is crystalline include the confirmation of a melting temperature by a differential scanning calorimeter (DSC), the confirmation of a crystal scattering peak by X-ray diffraction, and the like.

The melting temperature of the crystalline acrylate-based polymer block is measured by, for example, a method (DSC method) prescribed in ASTM D3418-82.

Specifically, the melting temperature by DSC is measured based on ASTM D3418 by a differential scanning calorimeter (DSC-50) (manufactured by Shimadzu Corporation) provided with an automatic tangential treatment system. The measurement conditions are as follows.

Sample: 3 to 15 mg, preferably 5 to 10 mg

Measurement Method: The sample is put into an aluminum pan and an empty pan is used as a reference.

Temperature Curve: Temperature increase I (20° C. to 180° C., temperature increase rate 10° C./min)

The melting temperature is obtained by measuring a peak temperature in a heat absorption curve that is measured when the temperature increases in the temperature curve.

The crystalline acrylate-based polymer block satisfying the above-described characteristics is preferably a polymer of alkyl acrylate having an alkyl group with a carbon number of from 19 to 25 (preferably from 21 to 25).

Examples of the alkyl acrylate include hexadecyl acrylate, heptadecyl acrylate, octadecyl acrylate, nonadecyl acrylate, eicosyl acrylate, heneicosyl acrylate, docosyl acrylate, tricosyl acrylate, tetracosyl acrylate, pentacosyl acrylate, and the like.

Among them, particularly, stearyl acrylate and behenyl acrylate are preferable as the acryl acrylate.

That is, the crystalline acrylate-based polymer block is preferably a polymer block of a monomer of at least one selected from stearyl acrylate and behenyl acrylate (particularly preferably a polymer block constituted by a copolymer of stearyl acrylate and behenyl acrylate). When this crystalline acrylate-based polymer block is applied, all of the strength, the charge stability and the heat storage property of the toner are easily improved.

The crystalline acrylate-based polymer block may be constituted by, for example, a copolymer of an acrylate-based monomer and other monomers.

Examples of the other monomers include acrylic acid (AA), methacrylic acid, maleic acid, fumaric acid, itaconic acid and the like.

The mass ratio (other monomers/whole styrene-based block) of the other monomers is preferably in the range of from 0.1% to 3%.

Here, when the styrene-based polymer block is denoted by A and the crystalline acrylate-based polymer block is denoted by B, the block copolymer may be, for example, an A-B block copolymer or an A-B-A block copolymer.

Other items about the polyester resin will be described.

In the polyester resin, the mass ratio of the block copolymer (block copolymer (styrene-based polymer block+crystalline acrylate-based polymer block)/(block copolymer+main chain polyester skeleton)×100) is for example, from 10 to 60, preferably from 20 to 50, and more preferably from 30 to 50.

In addition, In the block copolymer (styrene-based polymer block+crystalline acrylate-based polymer block), the mass ratio of the styrene-based polymer block (styrene-based polymer block/whole block copolymer) is, for example, from 2 to 30, preferably from 5 to 25, and more preferably from 10 to 20.

When these mass ratios are in the above-described ranges, all of the strength, the charge stability and the heat storage property of the toner are easily improved.

In the polyester resin, the weight average molecular weight (Mw) of the polyester skeleton is, for example, from 10000 to 30000, preferably from 15000 to 25000, and more preferably from 20000 to 25000.

The number average molecular weight (Mn) of the styrene-based polymer block in the block copolymer is, for example, from 1000 to 20000, preferably from 3000 to 15000, and more preferably from 5000 to 13000.

The number average molecular weight (Mn) of the acrylate-based polymer block in the block copolymer is, for example, from 1000 to 40000, preferably from 15000 to 30000, and more preferably from 20000 to 25000.

The weight average molecular weight and the number average molecular weight are measured by gel permeation chromatography (GPC). The molecular weight measurement by GPC is performed using GPC.HCL-8120 (manufactured by Tosoh Corporation) and a column TSKgel Super HM-M (15 cm) (manufactured by Tosoh Corporation) as measurement devices with a THF catalyst. The weight average molecular weight and the number average molecular weight are calculated by using a molecular weight calibration curve that is made by a monodisperse polystyrene standard sample from the results of the above measurement. Hereinafter, these are calculated in the same manner as above.

The content of the polyester resin is, for example, from 40% by mass to 95% by mass, preferably from 50% by mass to 90% by mass, and more preferably from 60% by mass to 85% by mass.

A method of synthesizing a polyester resin will be described.

First, a styrene-based monomer is polymerized to obtain a styrene-based polymer block (polymer of the styrene-based monomer).

Next, a crystalline acrylate-based monomer is separately polymerized to obtain a crystalline acrylate polymer block (polymer of the crystalline acrylate-based monomer).

The obtained styrene-based polymer block and crystalline acrylate polymer block are subjected to block polymerization to obtain a block copolymer.

Using, for example, a general polyester polymerization method (for example, direct polycondensation, transesterification and the like) of reacting polyvalent carboxylic acid with polyol, a polycondensate serving as a polyester skeleton is obtained.

Next, the block copolymer is graft polymerized to the obtained polycondensate serving as a polyester skeleton to obtain a graft polymer.

The graft polymerization is performed using, for example, a styrene-dormant living radical polymerization method.

By using the living radical polymerization method, a polyester resin is obtained that is constituted by a graft polymer in which the styrene-based polymer block of the block copolymer is grafted onto the polyester skeleton.

Here, as binder resins, resins (other binder resins) other than the above-described polyester resin may be contained in toner particles without damaging the function.

Examples of the other binder resins include known resins such as other polyester resins, vinyl-based resins, styrene/acrylic-based resins, epoxy resins, polyurethane resins, polyamide resins, cellulose resins, polyether resins, and polyolefin resins.

The colorant will be described.

The colorant is not particularly limited if it is a known colorant. Examples thereof include carbon black such as farness black, channel black, acetylene black and thermal black, inorganic pigments such as colcothar, Prussian blue and titanium oxide, azo pigments such as Fast yellow, disazo yellow, pyrazolone red, chelate red, brilliant carmine and para Brown, phthalocyanine pigments such as copper phthalocyanine and metal-free phthalocyanine, and condensed polycyclic dyes such as flavanthrone yellow, dibromoanthrone orange, perylene red, quinacridone red and dioxazine violet.

Regarding the colorant, if necessary, a surface-treated colorant may be used and a dispersant may be used in combination. In addition, various kinds of colorants may be used in combination.

The content of the colorant is preferably in the range of from 1 part by mass to 30 parts by mass with respect to 100 parts by mass of the binder resin.

The release agent will be described.

Examples of the release agent include hydrocarbon-based wax; natural wax such as carnauba wax, rice wax and candelilla wax; synthetic or mineral and petroleum-based wax such as montan wax; ester-based wax such as fatty acid ester and montanic acid ester; and the like. However, the release agent is not limited thereto.

From the point of view of preservability, the melting point of the release agent is preferably 50° C. or higher, and more preferably 60° C. or higher. In addition, from the point of offset resistance, the melting point is preferably 110° C. or lower, and more preferably 100° C. or lower.

The content of the release agent is preferably, for example, in the range of from 2 parts by mass to 30 parts by mass with respect to 100 parts by mass of the binder resin.

Other additives will be described.

Examples of the other additives include a magnetic material, a charge-controlling agent, an inorganic powder and the like.

The characteristics of the toner particles will be described.

The toner particles may be toner particles having a single layer structure, or may be toner particles having a so-called core-shell structure constituted by a core body (core particle) and a cover layer (shell layer) covering the core body.

In the case of toner particles having a core-shell structure, the cover layer (shell layer) preferably contains a polyester resin, and the core body (core particle) preferably contains a polyester resin, and if necessary, a colorant, a release agent, and other additives.

The volume average particle size of the toner particles is, for example, from 2.0 μm to 10 μm, and preferably from 4.0 μm to 8.0 μm.

In a method of measuring the volume average particle size of the toner particles, from 0.5 mg to 50 mg of a measurement sample is added to 2 ml of an aqueous solution of 5% by mass of a surfactant as a dispersant, preferably sodium alkylbenzene sulfonate. Then, the resultant material is added to from 100 ml to 150 ml of the electrolyte. The electrolyte in which the measurement sample is suspended is subjected to a dispersion treatment for about 1 minute with an ultrasonic dispersing unit, and the Coulter Multisizer II (manufactured by Beckman Coulter, Inc.) measures a particle size distribution of particles having a particle size of from 2.0 μm to 60 μm by using an aperture having an aperture diameter of 100 μm. 50,000 particles are used for the measurement.

A volume cumulative distribution is drawn from the smallest diameter side for the obtained particle size distribution in divided particle size ranges (channels). The particle size corresponding to 50% in the cumulative distribution is defined as a volume average particle size D50v.

The external additive will be described.

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surface of the external additive may be subjected to a hydrophobization treatment in advance. The hydrophobization treatment is performed by, for example, dipping inorganic particles in a hydrophobization treatment agent. The hydrophobization treatment agent is not particularly limited, and examples thereof include a silane-based coupling agent, a silicon oil, a titanate-based coupling agent, an aluminum-based coupling agent, and the like. These may be used singly or in combination of two or more kinds.

Generally, the amount of the hydrophobization treatment agent is from about 1 part by mass to about 10 parts by mass with respect to 100 parts by mass of inorganic particles.

The amount of the external additive is, for example, from 0.5 part by mass to 2.5 parts by mass with respect to 100 parts by mass of toner particles.

A method of preparing the toner according to this exemplary embodiment will be described.

First, toner particles may be prepared by any of a dry preparation method (for example, a kneading pulverization method) and a wet preparation method (for example, an aggregation and coalescence method, a suspension polymerization method, a dissolution suspension granulation method, a dissolution suspension method, a dissolution emulsification aggregation and coalescence method and the like). The preparation method is not particularly limited and a well-known preparation method is employed.

In addition, a toner according to this exemplary embodiment is prepared by, for example, adding and mixing an external additive in the dried toner particles. The mixing is preferably performed by, for example, a V-blender, a Henschel mixer, a Loedige mixer or the like. If necessary, coarse toner particles of the toner may be removed by using a vibration sieve, a wind-power sieve or the like.

(Electrostatic Charge Image Developer)

An electrostatic charge image developer according to this exemplary embodiment contains at least a toner according to this exemplary embodiment.

The electrostatic charge image developer according to this exemplary embodiment may be a single-component developer containing only the toner according to this exemplary embodiment, or a two-component developer in which the toner and a carrier are mixed.

The carrier is not particularly limited, and examples thereof include known carriers such as a resin-coated carrier, a magnetism dispersion-type carrier and a resin dispersion-type carrier.

The mixing ratio (mass ratio) between the toner according to this exemplary embodiment and the carrier in the two-component developer is preferably in the range of from about 1:100 to about 30:100 (toner:carrier), and more preferably in the range of from about 3:100 to about 20:100.

(Image Forming Apparatus/Image Forming Method)

Next, an image forming apparatus/image forming method according to this exemplary embodiment will be described.

An image forming apparatus according to this exemplary embodiment has: an image holding member; a charging section that charges the image holding member; an electrostatic charge image forming section that forms an electrostatic charge image on a surface of the charged image holding member; a developing section that contains an electrostatic charge image developer and develops the electrostatic charge image formed on the image holding member by the electrostatic charge image developer to form a toner image; a transfer section that transfers the toner image formed on the image holding member onto a transfer medium; and a fixing section that fixes the toner image transferred onto the transfer medium. The above-described electrostatic charge image developer according to this exemplary embodiment is applied as an electrostatic charge image developer.

In the image forming apparatus according to this exemplary embodiment, for example, a portion including the developing section may have a cartridge structure (process cartridge) that is detachable from the image forming apparatus. As the process cartridge, for example, a process cartridge that accommodates the electrostatic charge image developer according to this exemplary embodiment and is provided with a developing section is appropriately used.

An image forming method according to this exemplary embodiment has: a charging process of charging the image holding member; an electrostatic charge image forming process of forming an electrostatic charge image on a surface of the charged image holding member; a developing process of developing the electrostatic charge image formed on the image holding member by the electrostatic charge image developer as a toner image; a transfer process of transferring the toner image formed on the image holding member onto a transfer medium; and a fixing process of fixing the toner image transferred onto the transfer medium. The above-described electrostatic charge image developer according to this exemplary embodiment is applied as an electrostatic charge image developer.

Hereinafter, an example of the image forming apparatus according to this exemplary embodiment will be shown, but the apparatus is not limited thereto. The main portions shown in the drawing will be described, and descriptions of other portions will be omitted.

FIG. 1 is a diagram schematically showing the configuration of a 4-drum tandem color image forming apparatus. The image forming apparatus shown in FIG. 1 is provided with first to fourth image forming units 10Y, 10M, 10C, and 10K (image forming sections) of an electrophotographic type that output color images of yellow (Y), magenta (M), cyan (C), and black (K), respectively, based on color-separated image data. The image forming units (hereinafter, simply referred to as "units" in some cases) 10Y, 10M, 10C, and 10K are arranged with a predetermined distance therebetween in the horizontal direction. The units 10Y, 10M, 10C, and 10K may be process cartridges that may be detachable from the image forming apparatus body.

An intermediate transfer belt 20 as an intermediate transfer member is disposed above the units 10Y, 10M, 10C, and 10K in the drawing to extend via the units. The intermediate transfer belt 20 is wound on a driving roller 22 and a support roller 24 contacting the inner surface of the intermediate transfer belt 20, which are separated from each other on the left and right sides in the drawing, and travels in the direction toward the fourth unit 10K from the first unit 10Y. The support roller 24 is impelled in the direction in which it gets away from the driving roller 22 by a spring or the like (not shown), and thus tension is provided to the intermediate transfer belt 20 wound on both of the rollers. In addition, an intermediate transfer member cleaning device 30 opposed to the driving roller 22 is provided in a surface of the intermediate transfer belt 20 on the image holding member side.

Developing devices (developing sections) 4Y, 4M, 4C, and 4K of the units 10Y, 10M, 10C, and 10K may be supplied with toners respectively including four color toners of yellow, magenta, cyan, and black contained in toner cartridges 8Y, 8M, 8C, and 8K, respectively.

The above-described first to fourth units 10Y, 10M, 10C, and 10K have the same configuration, and thus only the first unit 10Y that is used for forming a yellow image and is disposed on the upstream side in the traveling direction of the intermediate transfer belt will be representatively described. The same portions as in the first unit 10Y will be denoted by the reference numerals having magenta (M), cyan (C), and black (K) added instead of yellow (Y), and descriptions of the second to fourth units 10M, 10C, and 10K will thus be omitted.

The first unit 10Y has a photoreceptor 1Y serving as an image holding member. Around the photoreceptor 1Y, a charging roller 2Y that charges a surface of the photoreceptor 1Y to a predetermined potential, an exposure device (electrostatic charge image forming section) 3 that exposes the charged surface with a laser beam 3Y based on a color-separated image signal to form an electrostatic charge image, a developing device (developing section) 4Y that supplies a charged toner to the electrostatic charge image to develop the electrostatic charge image, a primary transfer roller (primary transfer section) 5Y that transfers the developed toner image onto the intermediate transfer belt 20, and a photoreceptor cleaning device (cleaning section) 6Y that removes the toner remaining on the surface of the photoreceptor 1Y after the primary transfer, are arranged in sequence.

The primary transfer roller 5Y is disposed inside the intermediate transfer belt 20 and is provided at a position opposed to the photoreceptor 1Y. Bias supplies (not shown) that apply a primary transfer bias are connected to the primary transfer rollers 5Y, 5M, 5C, and 5K, respectively. The bias supplies change the transfer bias that is applied to the respective primary transfer rollers under the control of a controller (not shown).

Hereinafter, the operation of forming a yellow image in the first unit 10Y will be described. First, before the operation, the surface of the photoreceptor 1Y is charged to a potential of from about −600 V to about −800 V by the charging roller 2Y.

The photoreceptor 1Y is formed by stacking a photoconductive layer on a conductive base (volume resistivity at 20° C.: $1\times10^{-6}$ Ωcm or less). This photoconductive layer typically has high resistance (resistance corresponding to the resistance of a general resin), but has a property that, when the laser beam 3Y is applied thereto, the specific resistance of a portion irradiated with the laser beam changes. Accordingly, the laser beam 3Y is output to the surface of the charged photoreceptor 1Y via the exposure device 3 in accordance with image data for yellow sent from the controller (not shown). The laser beam 3Y is applied to the photoconductive layer on the surface of the photoreceptor 1Y, whereby an electrostatic charge image of a yellow print pattern is formed on the surface of the photoreceptor 1Y.

The electrostatic charge image is an image formed on the surface of the photoreceptor 1Y by the charging, and is a so-called negative latent image, that is formed by applying the laser beam 3Y to the photoconductive layer so that the specific resistance of the irradiated portion is lowered to cause charges to flow on the surface of the photoreceptor 1Y and cause charges to stay in a portion to which the laser beam 3Y is not applied.

The electrostatic charge image that is formed in this manner on the photoreceptor 1Y is rotated to a predetermined development position with the travelling of the photoreceptor 1Y. The electrostatic charge image on the photoreceptor 1Y is visualized (to form a developed image) at the development position by the developing device 4Y.

The electrostatic charge image developer according to this exemplary embodiment including, for example, at least a yellow toner and a carrier is accommodated in the developing device 4Y. The yellow toner is frictionally charged by being stirred in the developing device 4Y to have a charge with the same polarity (negative polarity) as the electrified charge on the photoreceptor 1Y, and is thus held on the developer roll (developer holding member). By allowing the surface of the photoreceptor 1Y to pass through the developing device 4Y, the yellow toner is electrostatically adhered to a latent image portion having no charge (erased) on the surface of the photoreceptor 1Y, whereby the latent image is developed with the yellow toner. Next, the photoreceptor 1Y having a yellow toner image formed thereon travels at a predetermined speed, and the developed toner image on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−) and is controlled to, for example, about +10 μA in the first unit 10Y by the controller (not shown).

On the other hand, the toner remaining on the photoreceptor 1Y is removed and recovered by the cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply transferred in a superimposed manner.

The intermediate transfer belt 20 onto which four color toner images have been multiply transferred through the first to fourth units reaches a secondary transfer portion which includes the intermediate transfer belt 20, the support roller 24 contacting the inner surface of the intermediate transfer belt, and a secondary transfer roller (secondary transfer section) 26 disposed on the image supporting surface side of the intermediate transfer belt 20. On the other hand, a recording sheet (transfer medium) P is supplied to a gap between the secondary transfer roller 26 and the intermediate transfer belt 20, which are pressed against each other, at a predetermined time by a supply mechanism, and a secondary transfer bias is applied to the support roller 24. The transfer bias applied at this time has the same polarity (−) as the toner polarity (−) and an electrostatic force toward the recording sheet P from the intermediate transfer belt 20 acts on the toner image, whereby the toner image on the intermediate transfer belt 20 is transferred onto the recording sheet P. The secondary transfer bias is determined depending on the resistance detected by a resistance detector (not shown) that detects the resistance of the secondary transfer portion, and is voltage-controlled.

Thereafter, the recording sheet P is fed to a pressed portion (nip portion) of a pair of fixing rolls in the fixing device (roll-like fixing section) 28, and the toner image is fixed onto the recording sheet P. Thus, a fixed image is formed.

Examples of the transfer medium onto which the toner image is to be transferred include plain paper sheets and OHP sheets that are used in electrophotographic copiers, printers, and the like.

In order to further improve the smoothness of an image surface after the fixing, the surface of the transfer medium is preferably as smooth as possible. For example, a coated sheet obtained by coating the surface of a plain paper sheet with a resin or the like, an art paper sheet for printing or the like may be appropriately used.

The recording sheet P on which the fixation of the color image is completed is transported toward a discharge portion, and a series of color image forming operations end.

The image forming apparatus exemplified as above has a configuration in which the toner image is transferred onto the recording sheet P via the intermediate transfer belt 20. However, the invention is not limited to this configuration, and may have a structure in which the toner image may be transferred directly onto the recording sheet from the photoreceptor.

<Process Cartridge, Toner Cartridge>

Figure 2:
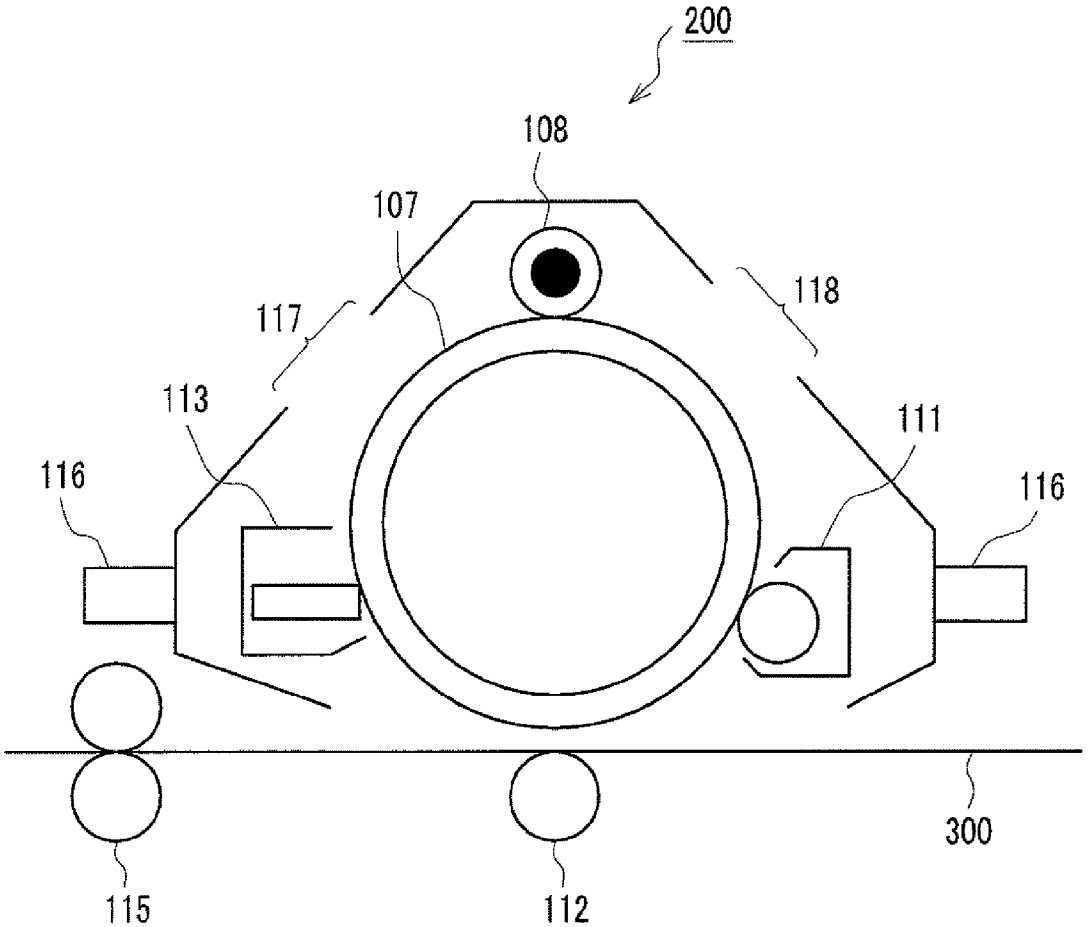
FIG. 2 is a diagram schematically showing the configuration of an example of a process cartridge according to the exemplary embodiment.

FIG. 2 is a diagram schematically showing the configuration of an appropriate exemplary embodiment of the process cartridge that accommodates the electrostatic charge image developer according to this exemplary embodiment. A process cartridge 200 has, in addition to a photoreceptor 107, a charging roller 108, a developing device 111, a photoreceptor cleaning device 113, an opening portion 118 for exposure, and an opening portion 117 for erasing exposure that are attached thereto, and combined and integrated using an attachment rail 116. The reference numeral 300 in FIG. 2 represents a transfer medium.

The process cartridge 200 is detachable from an image forming apparatus including a transfer device 112, a fixing device 115 and other constituent portions (not shown).

The process cartridge 200 shown in FIG. 2 includes the charging roller 108, the developing device 111, the cleaning device 113, the opening portion 118 for exposure, and the opening portion 117 for erasing exposure, but these devices maybe selectively combined. The process cartridge according to this exemplary embodiment may include, in addition to the photoreceptor 107, at least one selected from the group consisting of the charging roller 108, the developing device 111, the cleaning device (cleaning section) 113, the opening portion 118 for exposure, and the opening portion 117 for erasing exposure.

The toner cartridge according to this exemplary embodiment will be described. The toner cartridge according to this exemplary embodiment is a toner cartridge that is detachable from the image forming apparatus and accommodates at least an electrostatic charge image developing toner for refill for supplying to the developing section provided in the image forming apparatus.

The image forming apparatus shown in FIG. 1 is an image forming apparatus that has a configuration in which the toner cartridges 8Y, 8M, 8C, and 8K are detachably mounted. The developing devices 4Y, 4M, 4C, and 4K are connected to the toner cartridges corresponding to the respective developing devices (colors) via toner supply tubes (not shown). In addition, when the toner accommodated in a toner cartridge runs low, the toner cartridge is replaced.

EXAMPLES

Hereinafter, this exemplary embodiment will be described in detail using Examples, but is not limited to any of these Examples. In the following description, "parts" and "%" are based on mass, unless specifically noted.

[Preparation of Resin Particle Dispersion]

(Preparation of Polyester Resin Particle Dispersion A)

First, a block copolymer composed of a styrene-based polymer block and a crystalline acrylate-based polymer block is synthesized as follows.

<Synthesis of 2-methyl-2-[N-(tert-butyl)-N-(1-diethoxyphosphoryl-2,2-dimethylpropyl)-aminoxy]-propionic acid (MBPAP)>

500 parts of degassed toluene, 35.9 parts of CuBr, 15.9 parts of a copper powder and 86.7 parts of N,N,N',N',N''-Penta-methyldiethylene triamine are introduced into a glass container with a reflux condenser tube purged with nitrogen. While the materials are stirred, 580 parts of degassed toluene, 42.1 parts of 2-bromo-2-methylpropionic acid, and 78.9 parts of N-tert-butyl-N-(1-diethylphosphono-2,2-dimethylpropyl) nitroxide are introduced and stirred for 90 minutes at room temperature. After that, the reaction medium is filtered, and further, toluene filtrate is washed with an $NH_4Cl$ saturated aqueous solution two times. The obtained solid is washed with pentane and vacuum dried to obtain 2-methyl-2-[N-(tert-butyl)-N-(1-diethoxyphosphoryl-2,2-dimethylpropyl)-aminoxy]-propionic acid (MBPAP).

The molar mass of the prepared MBPAP obtained by mass spectrometry is 381.44 g/mol ($C_{17}H_{36}NO_6P$), that is confirmed to be a target product.

<Polymerization of Block Copolymer 1>

83.1 parts of a stearyl acrylate monomer and 100 parts of a toluene solution in which 1.27 parts of the MBPAP is dissolved are added to a glass container having a reflux condenser tube, a nitrogen introducing tube and a stirrer attached thereto, and are mixed well at 80° C. under a nitrogen gas stream, and the temperature is raised to 110° C. to polymerize the stearyl acrylate monomer for 8 hours (crystalline acrylate-based polymer block). When frequently measuring the molecular weight by GPC, the number average molecular weight is 19980 and deviates from 20000, that is a theoretical value thereof, by less than 5%, and excellent living controllability is exhibited.

Thereafter, the temperature is lowered to 80° C., and then 16.9 parts of a styrene monomer is dropped and the temperature is raised again to 110° C. to further polymerize the polymerized material continuously for 8 hours to thereby conduct chain extension (styrene-based polymer block). When measuring the molecular weight of the polymer, the entire number average molecular weight is 25080, and the total number average molecular weight derived from the styrene polymer block from which the molecular weight of the block B is subtracted is 5100 and deviates from 5000, that is a theoretical value thereof, by less than 5%. Excellent chain extension is shown.

The polymerized material is dissolved in 100 parts of THF to be taken and is dropped to methanol to reprecipitate a block copolymer 1. Thereafter, the precipitate is filtered and washed repeatedly with methanol and is then vacuum dried at 40° C., and thus the block copolymer 1 is obtained.

When performing the DSC measurement of the block copolymer after drying, the melting temperature derived from the crystalline acrylate block is 49° C.

<Polymerization of Polyester Resin A>

Next, a polycondensate serving as a polyester skeleton is synthesized as follows.

25 molar parts of polyoxyethylene(2,0)-2,2-bis(4-hydroxyphenyl)propane (BPAEO=bisphenol A ethylene oxide adduct), 25 molar parts of polyoxypropylene(2,2)-2,2-bis(4-hydroxyphenyl)propane (BPAPO=bisphenol A propylene oxide adduct), 30 molar parts of terephthalic acid (TPA), 10 molar parts of n-dodecenyl succinic acid (DSA), 10 molar parts of fumaric acid (FA), and 0.05 molar parts of dibutyl tin oxide with respect to the acid components (total number of mots of terephthalic acid, fumaric acid and n-dodecenylsuccinic acid) are put into a heat-dried two-neck flask. A nitrogen gas is introduced into the container, and with the inside of the flask maintained under an inert atmosphere, the temperature is raised and co-condensation polymerization is then conducted for 12 to 20 hours at 150° C. to 230° C. Subsequently, at 210° C. to 250° C., the pressure is gradually reduced, and thus a polycondensate serving as a polyester skeleton is synthesized. When measuring the molecular weight of the obtained polycondensate, the number average molecular weight Mn is 6020 and the weight average molecular weight Mw is 25300.

Next, the obtained polycondensate serving as a polyester skeleton and the block polymer are graft polymerized to each other as follows to synthesize a graft polymer, and the graft polymer is set as a polyester resin A.

40 parts of the block copolymer 1 with respect to 100 parts of the polycondensate serving as a polyester skeleton is dissolved in 70 parts of toluene and is then charged into a flask with a condenser tube. Thereafter, the materials are heated and mixed for 5 hours at 120° C. under a nitrogen gas stream.

Next, the polymerized material is dissolved in 100 parts of THF to be taken and is dropped to methanol to reprecipitate a block copolymer 1. Thereafter, the precipitate is filtered and washed repeatedly with methanol and is then vacuum dried at 40° C., and thus a polyester resin A is obtained.

By the DSC measurement of the polyester resin A after drying, it is confirmed that the melting temperature derived from the crystalline acrylate block is 49° C. In addition, when measuring the molecular weight thereof, the weight average molecular weight is 44000 (RI detector), and when changing the detector to an UV detector (wavelength 254 nm), the weight average molecular weight is similarly 44010, and RI and UV peaks substantially overlap each other. Therefore, it is confirmed that grafting of the polycondensate serving as a polyester skeleton and the crystalline block copolymer has been completed well.

Next, 3000 parts by mass of the obtained polyester resin A, 10000 parts by mass of ion exchange water, and 90 parts by mass of sodium dodecylbenzenesulfonate are put into an emulsification tank of a high-temperature and high-pressure emulsifier (CAVITRON CD1010), and then heated to 130° C. and melted. After that, the resultant material is dispersed at 10000 rpm, a flow rate of 3 L/m, and 110° C. for 30 minutes, and passes through a cooling tank to prepare a polyester resin particle dispersion A having a solid content of 30% and a volume average particle size D50v of 115 nm.

(Preparation of Polyester Resin Dispersion B)

A block copolymer 2 composed of a crystalline acrylate-based polymer block and a styrene-based polymer block is synthesized in the same manner as in the case of the block copolymer 1, except that an acrylate monomer to be used is changed from stearyl acrylate to 80 parts of a behenyl acrylate monomer and 20 parts of a styrene monomer.

The melting temperature of the copolymer is 69° C., and the number average molecular weight is 24980 (styrene block number average molecular weight=4970, behenyl acrylate block number average molecular weight=20010).

A polyester resin B and a polyester resin dispersion B are prepared in the same manner as in the case of the preparation of the polyester resin dispersion A using 100 parts of a polycondensate serving as a polyester skeleton that is used in the preparation of the polyester resin dispersion A, except for use of 30 parts of the obtained block copolymer 2.

By the DSC measurement of the polyester resin B after drying, it is confirmed that the melting temperature derived from the crystalline acrylate block is 69° C. In addition, when measuring the molecular weight thereof, the weight average molecular weight is 49000 (RI detector), and when changing the detector to an UV detector (wavelength 254 nm), the weight average molecular weight is similarly 49060, and RI and UV peaks substantially overlap each other. Therefore, it is confirmed that grafting of the polycondensate serving as a polyester skeleton and the crystalline block copolymer has been completed well.

In addition, the solid content of the obtained polyester resin dispersion B is 30%, and the volume average particle size D50v is 125 nm.

(Preparation of Polyester Resin Dispersion C)

A block copolymer 3 composed of a crystalline acrylate-based polymer block and a styrene-based polymer block is synthesized in the same manner as in the case of the block copolymer 1, except that an acrylate monomer to be used is changed from stearyl acrylate to 80 parts of a mixture prepared to have a weight ratio of 20:80 between stearyl acrylate and behenyl acrylate and 20 parts of a styrene monomer. The melting temperature of the copolymer is 60° C., and the number average molecular weight is 29730 (styrene block number average molecular weight=4950, stearyl-behenyl acrylate block number average molecular weight=20100).

A polyester resin C and a polyester resin dispersion C are prepared in the same manner as in the case of the preparation of the polyester resin dispersion A using 100 parts of a polycondensate serving as a polyester skeleton that is used in the preparation of the polyester resin dispersion A, except for use of 30 parts of the obtained block copolymer 3.

By the DSC measurement of the polyester resin C after drying, it is confirmed that the melting temperature derived from the crystalline acrylate block is 60° C. In addition, when measuring the molecular weight thereof, the weight average molecular weight is 50100 (RI detector), and when changing the detector to an UV detector (wavelength 254 nm), the weight average molecular weight is similarly 50150, and RI and UV peaks substantially overlap each other. Therefore, it is confirmed that grafting of the polycondensate serving as a polyester skeleton and the crystalline block copolymer has been completed well.

In addition, the solid content of the obtained polyester resin dispersion C is 30%, and the volume average particle size D50v is 124 nm.

(Preparation of Polyester Resin Dispersion D)

A block copolymer 4 composed of a crystalline acrylate-based polymer block and a styrene-based polymer block is synthesized in the same manner as in the case of the block copolymer 1, except that an acrylate monomer to be used is changed from a stearyl acrylate monomer to 80 parts of a mixture prepared to have a weight ratio of 20:80 between stearyl acrylate and a behenyl acrylate monomer and a styrene monomer is changed to 20 parts of a mixture prepared to have a weight ratio of 95:5 between a styrene monomer and an acrylic acid monomer. The melting temperature of the copolymer is 60° C., and the number average molecular weight is 25200 (styrene block number average molecular weight=4900, stearyl-behenyl acrylate block number average molecular weight=20300).

A polyester resin D and a polyester resin dispersion D are prepared in the same manner as in the case of the preparation of the polyester resin dispersion A using 100 parts of a polycondensate serving as a polyester skeleton that is used in the preparation of the polyester resin dispersion A, except for use of 30 parts of the obtained block copolymer 4.

By the DSC measurement of the polyester resin D after drying, it is confirmed that the melting temperature derived from the crystalline acrylate block is 60° C. In addition, when measuring the molecular weight thereof, the weight average molecular weight is 50200 (RI detector), and when changing the detector to an UV detector (wavelength 254 nm), the weight average molecular weight is similarly 50110, and RI and UV peaks substantially overlap each other. Therefore, it is confirmed that grafting of the polycondensate serving as a polyester skeleton and the crystalline block copolymer has been completed well.

In addition, the solid content of the obtained polyester resin dispersion D is 30%, and the volume average particle size D50v is 114 nm.

(Preparation of Polyester Resin Dispersion E)

A polyester resin E and a polyester resin dispersion E are prepared in the same manner as in the case of the polyester resin dispersion A using 25 parts of a block copolymer 3 composed of blocks that is used in the preparation of the polyester resin dispersion C and 100 parts of a polycondensate serving as a polyester skeleton that is used in the preparation of the polyester resin dispersion A.

By the DSC measurement of the polyester resin E after drying, it is confirmed that the melting temperature derived from the crystalline acrylate block is 60° C. In addition, when measuring the molecular weight thereof, the weight average molecular weight is 40200 (RI detector), and when changing the detector to an UV detector (wavelength 254 nm), the weight average molecular weight is similarly 40210, and RI and UV peaks substantially overlap each other. Therefore, it is confirmed that grafting of the polycondensate serving as a polyester skeleton and the crystalline block copolymer has been completed well.

In addition, the solid content of the obtained polyester resin dispersion E is 30%, and the volume average particle size D50v is 120 nm.

(Preparation of Polyester Resin Dispersion F)

A polyester resin F is prepared as in the case of the polyester resin A, except that the stearyl acrylate monomer that is a crystalline acryl monomer of the polyester resin A prepared in the preparation of the polyester resin dispersion A is changed to a hexadecyl acrylate monomer.

In addition, using the polyester resin F, a polyester resin dispersion F is prepared in the same manner as in the case of the polyester resin dispersion A.

By the DSC measurement of the polyester resin F after drying, it is confirmed that the melting temperature derived from the crystalline acrylate block is 42° C. In addition, when measuring the molecular weight thereof, the weight average molecular weight is 44130 (RI detector), and when changing the detector to an UV detector (wavelength 254 nm), the weight average molecular weight is similarly 44030, and RI and UV peaks substantially overlap each other. Therefore, it is confirmed that grafting of the polycondensate serving as a polyester skeleton and the crystalline block copolymer has been completed well.

In addition, the solid content of the obtained polyester resin dispersion F is 30%, and the volume average particle size D50v is 123 nm.

(Preparation of Polyester Resin Dispersion G)

40 parts of a block copolymer 1 that is used in the preparation of the polyester resin dispersion A, 25 molar parts of polyoxyethylene(2,0)-2,2-bis(4-hydroxyphenyl)propane (BPAEO=bisphenol A ethylene oxide adduct), 25 molar parts of polyoxypropylene(2,2)-2,2-bis(4-hydroxyphenyl)propane (BPAPO=bisphenol A propylene oxide adduct), 40 molar parts of terephthalic acid (TPA), 10 molar parts of fumaric acid (FA), and 0.05 molar parts of dibutyl tin oxide with respect to the acid components (total number of mols of terephthalic acid and fumaric acid) are put to conduct grafting with 100 parts of a polycondensate serving as a polyester skeleton that is polycondensed in the same manner as in the case of the preparation of the polyester resin dispersion A, and thus a polyester resin G is obtained.

By the DSC measurement of the polyester resin G after drying, it is confirmed that the melting temperature derived from the crystalline acrylate block is 49° C. In addition, when measuring the molecular weight thereof, the weight average molecular weight is 47100 (RI detector), and when changing the detector to an UV detector (wavelength 254 nm), the weight average molecular weight is similarly 48010, and RI and UV peaks substantially overlap each other. Therefore, it is confirmed that grafting of the polycondensate serving as a polyester skeleton and the crystalline block copolymer has been completed well.

In addition, the solid content of the obtained polyester resin dispersion G is 30%, and the volume average particle size D50v is 128 nm.

(Preparation of Polyester Resin Dispersion H)

100 parts of a behenyl acrylate monomer and 100 parts of a toluene solution in which 1.27 parts of the MBPAP is dissolved are added to a glass container having a reflux condenser tube, a nitrogen introducing tube and a stirrer attached thereto, and are mixed well at 80° C. under a nitrogen gas stream, and the temperature is raised to 110° C. to polymerize the behenyl acrylate monomer for 8 hours. The polymerized material is reprecipitated in methanol and purified in the same manner as in the case of the block copolymer 1, and then the resin is dried. When measuring the molecular weight of the resin after drying by GPC, the number average molecular weight is 29980, and the melting temperature is 69° C.

30 parts of the obtained resin and 70 parts of a polycondensate serving as a polyester skeleton that is used in the polyester resin particle dispersion A (TPA (30)/DSA (10)/FA (10)/BPAEO (25)/BPAPO (25)) are melted and mixed at a temperature of 150° C. by a desktop kneader (manufactured by IRIE SHOKAI Co., Ltd., PBV-01), and is then cooled up to room temperature. Then, using a high-temperature and high-pressure emulsifier, a polyester resin dispersion H is obtained in the same manner as in the case of the polyester resin particle dispersion A. The solid content of the obtained polyester resin dispersion H is 30%, and the volume average particle size D50v is 328 nm.

(Preparation of Polyester Resin Dispersion I)

138 parts of 1,12-dodecane dicarboxylic acid, 92.3 parts of 1,9-nonane diol, and 0.05 molar parts of dibutyl tin oxide with respect to the acid component (number of mole of 1,12-dodecane dicarboxylic acid) are put into a heat-dried two-neck flask. A nitrogen gas is introduced into the container, and with the inside of the flask maintained under an inert atmosphere, the temperature is raised and co-condensation polymerization is then conducted for 3 hours at 150° C. to 180° C. Subsequently, at 180° C., the pressure is gradually reduced, and thus a polycondensate of 1,12-dodecane dicarboxylic acid and 1,9-nonane diol is synthesized. When measuring the molecular weight of the obtained polycondensate, the weight average molecular weight Mw is 21300 and the melting temperature is 73° C.

40 parts of the obtained polycondensate and 60 parts of a polycondensate serving as a polyester skeleton that is used in the polyester resin particle dispersion A (TPA (30)/DSA (10)/FA (10)/BPAEO (25)/BPAPO (25)) are melted and mixed at a temperature of 150° C. by a desktop kneader (manufactured by IRIE SHOKAI Co., Ltd., PBV-01), and is then cooled up to room temperature. Then, using a high-temperature and high-pressure emulsifier, a polyester resin dispersion I is obtained in the same manner as in the case of the polyester resin particle dispersion A. The solid content of the obtained polyester resin dispersion I is 30%, and the volume average particle size D50v is 278 nm.

[Preparation of Colorant Dispersion]

45 parts by mass of carbon black (Regal 330, prepared by Cabot Corporation), 5 parts by mass of an ionic surfactant Neogen R (prepared by Dai-ichi Kogyo Seiyaku Co., Ltd.), and 200 parts by mass of ion exchange water are mixed and dissolved, and are dispersed for 10 minutes by a homogenizer (manufactured by IKA Works Gmbh & Co. KG, Ultra Turrax). Next, the resultant material is subjected to a dispersion treatment by using Ultimizer to obtain a colorant dispersion having a solid content of 20% and a medium particle size of 245 nm.

[Preparation of Release Agent Dispersion]

45 parts by mass of paraffin wax (prepared by Nippon Seiro Col, Ltd., HNP 0190), 5 parts by mass of an ionic surfactant Neogen R (prepared by Dai-ichi Kogyo Seiyaku Co., Ltd.), and 200 parts by mass of ion exchange water are heated to 120° C. and subjected to a dispersion treatment by a pressure discharge-type Gaulin homogenizer. Thus, a release agent dispersion having a solid content of 20% and a medium particle size of 219 nm.

Example 1

500 parts by mass of a polyester resin particle dispersion A, 85 parts by mass of a pigment dispersion, 94 parts by mass of a release agent dispersion, 5 parts by mass of aluminum sulfate (prepared by Wako Pure Chemical Industries, Ltd.), 10 parts by mass of sodium dodecylbenzenesulfonate, 50 parts by mass of a 0.3 M nitric acid aqueous solution, and 500 parts by mass of ion exchange water are contained in a round stainless steel flask and dispersed using a homogenizer (manufactured by IKA Works Gmbh & Co. KG, Ultra Turrax T-50). Then, the resultant material is heated up to 50° C. in an oil bath for heating while being stirred. The resultant material is held at 50° C. After confirmation of the formation of aggregated particles having a volume average particle size of about 5.5 μm, 233 parts by mass of an additional polyester resin particle dispersion liquid A is added, and then the resultant material is held for 30 minutes.

Next, 1 N aqueous sodium hydroxide is slowly added thereto until pH reaches 7.0. After that, the resultant material is heated up to 85° C. while being stirred, and is then held for 3 hours. A solution obtained by dissolving 1.0 parts by mass of ammonium persulfate (APS) in 10 parts by mass of ion exchange water is added to the obtained dispersion, and a mixture obtained by mixing 5.5 parts by mass of styrene (St) in 50 parts by mass of ion exchange water at a temperature of 8° C. and by further mixing 3 parts by mass of sodium dodecylbenzenesulfonate is dropped over 30 minutes to perform polymerization for 2 hours at 80° C. The reaction product is filtered and washed with ion exchange water, and then dried using a vacuum dryer to obtain toner particles.

In addition, 1.5 parts by mass of hydrophobic silica (prepared by Cabot Corporation, TS 720) is added to 50 parts by mass of the obtained toner particles and blended by a sample mill to obtain a toner.

Examples 2 to 7

Toner particles are obtained in the same manner as in Example 1, except that the kind of the polyester resin dispersion is changed in accordance with Tables 1 and 2.

In addition, 1.5 parts by mass of hydrophobic silica (prepared by Cabot Corporation, TS 720) is added to 50 parts by mass of the obtained toner particles and blended by a sample mill to obtain a toner.

Comparative Example 1

Comparative toner particles are obtained as follows.

Toner particles are obtained in the same manner as in Example 1, except that the used resin dispersion is the polyester resin dispersion I. In addition, 1.5 parts by mass of hydrophobic silica (prepared by Cabot Corporation, TS 720) is added to 50 parts by mass of the obtained toner particles and blended by a sample mill to obtain a comparative toner.

In addition, 1.5 parts by mass of hydrophobic silica (prepared by Cabot Corporation, TS 720) is added to 50 parts by mass of the obtained comparative toner particles and blended by a sample mill to obtain a comparative toner.

Comparative Example 2

Comparative toner particles are obtained as follows.

Toner particles are obtained in the same manner as in Example 1, except that the used resin dispersion is the polyester resin dispersion I. In addition, 1.5 parts by mass of hydrophobic silica (prepared by Cabot Corporation, TS 720) is added to 50 parts by mass of the obtained toner particles and blended by a sample mill to obtain a comparative toner.

In addition, 1.5 parts by mass of hydrophobic silica (prepared by Cabot Corporation, TS 720) is added to 50 parts by mass of the obtained comparative toner particles and blended by a sample mill to obtain a comparative toner.

[Evaluation]

(Preparation of Developer)

Using the toners and comparative toners obtained in the respective examples, developers are prepared as follows.

First, 100 parts of ferrite particles (prepared by Powdertech, average particle size 50 μm) and 1.5 parts of a methyl methacrylate resin (prepared by Mitsubishi Rayon Co., Ltd, molecular weight 95000, component ratio of 10000 or less is 5%) are put into a pressurizing kneader together with 500 parts of toluene, and stirred and mixed for 15 minutes at room temperature. Then, the temperature is raised up to 70° C. during the mixing under reduced pressure to distillate the toluene. After that, the resultant material is cooled and classified using a sieve of 105 μm to obtain a resin-covered ferrite carrier.

In addition, the toners are mixed with the resin-covered ferrite carrier, respectively, to prepare developers having a toner concentration of 7% by mass.

(Characteristic Evaluation)

Using the developers, toner evaluation is performed with a modified apparatus of DocuPrint C2425 (manufactured by Fuji Xerox Co., Ltd.). This printer uses a blade cleaner in cleaning of the toner left on a photoreceptor after transfer. In addition, plain paper (manufactured by Fuji Xerox Co., Ltd., C2) is used as a transfer medium. The obtained results are shown in Tables 1, 2, and 3.

-Toner Strength-

The toner strength is evaluated as follows.

Toner breakage caused by the cleaning blade on the photoreceptor of the above-described printer after continuous printing of 3000 solid images with an area coverage of 50%, and toner filming on the photoreceptor due to the toner breakage (generation of film-like stripes due to the toner breakage) are visually observed, and the toner left on the photoreceptor and the blade section are observed using a microscope.

The evaluation reference is as follows.

A: No filming, and no toner breakage is observed.

B: No filming, but slight toner breakage at a level not causing any practical problem is observed in the blade section.

C: Filming due to the toner breakage is observed on the photoreceptor, and practical problems occur.

-Aggregation in Developing Mechanism-

The aggregation in a developing mechanism is evaluated as follows.

The idle rotation of the developing mechanism is performed for 1 hour without print output to visually observe the presence or absence of the toner aggregation, and the developer is sampled to confirm the presence or absence of the toner aggregation by a microscope.

The evaluation reference is as follows.

A: Little aggregation is observed.

B: Slight aggregation is observed. Level not causing any practical problem.

C: Significant aggregation is observed. Level causing a practical problem.

-Toner Charge Stability-

The toner charge stability is evaluated as follows.

The developer is weighed in a glass bottle with a lid and seasoning is performed thereon for 24 hours at a high temperature and a high humidity (temperature 28° C., humidity 85%) and at a low temperature and a low humidity (temperature 10° C., humidity 15%). Thereafter, the charging amount (μC/g) of the toner after stirring and shaking for 5 minutes by a Turbula mixer is measured by a blow-off charging amount measuring device.

The evaluation reference is as follows.

A: The charging amount is 15 μC/g or greater, and little difference between the charging amounts under both the environments is generated.

B: The charging amount is 15 μC/g or greater, but a difference due to the environment is slightly observed. However, a level not causing any practical problem is achieved.

C: The charging amount is 15 μC/g or less, and a difference due to the environment is significant. Level causing a practical problem.

-Low-Temperature Fixability-

The low-temperature fixability is evaluated as follows.

The toner of a fixing roll of a fixing mechanism is set to be heated to 200° C. from 80° C., and then an image (40 mm×50 mm, 100% solid image) is fixed every 10° C. The image plane of each of the fixed images obtained as above is accordion-folded, and image peeling at the folded portion is observed. The temperature at which the image peeling disappears is set as a minimum fixing temperature. Using this method, the minimum fixing temperature is used in the evaluation of the low-temperature fixability.

The evaluation reference is as follows.

A: The fixing temperature is from 80° C. to 100° C. The fixing is possible.

B: The fixing temperature is higher than 100° C. and equal to or lower than 120° C.

C: The fixing temperature is higher than 120° C.

-Strength of Fixed Image-

The strength of a fixed image is evaluated as follows.

An image at the minimum fixing temperature is subjected to a pencil hardness test based on JIS K5400, and the following determination is performed using the pencil hardness. The results are shown in Table 1.

A: Level with no problems at the pencil hardness H or greater.

B: Some image defects are generated at the pencil hardness H, but no image defects are generated at less than H. Level not causing any practical problem.

C: Image defects are generated at less than the pencil hardness H. Level causing a practical problem.

-Preservability of Fixed Image-

The preservability of a fixed image is evaluated as follows.

Image planes of two recording sheets having a fixed image formed at the minimum fixing temperature overlap each other and are left for 7 days in a state in which a load of 100 g/cm$^2$ is applied thereto under an environment of a temperature of 60° C. and a humidity of 85%. The overlapping images are peeled off from each other to visually observe whether or not fusion occurs between the images of the recording sheets and whether or not there is a transfer to a non-image portion. The evaluation is performed in accordance with the following evaluation reference.

A: No problems in image preservability

B: A some slight change is observed, but there are no practical problems.

C: A great change is observed. Practically unusable.

The results of the above-described evaluations are shown in Tables 1 to 3.

TABLE 1

| | | | Example 1 | Example 2 | Example 3 | Example 4 | Example 5 |
|---|---|---|---|---|---|---|---|
| Polyester Resin Dispersion Kind | | | A | B | C | D | E |
| Block Copolymer Grafted onto Polyester Skeleton | Styrene-based Polymer Block | Monomer Kind (mass ratio in brackets) | Styrene | Styrene | Styrene | Styrene (95)/Acrylic Acid (5) | Styrene |
| | | Mass Ratio in Block Copolymer (% by mass) | 16.9 | 20 | 20 | 20 | 20 |
| | | Number Average Molecular Weight Mn | 5100 | 4970 | 4950 | 4900 | 4950 |
| | Crystalline Acrylate-based Polymer Block | Monomer Kind (mass ratio in brackets) | Stearyl Acrylate | Behenyl Acrylate | Stearyl Acrylate (20)/Behenyl Acrylate (80) | Stearyl Acrylate (20)/Behenyl Acrylate (80) | Stearyl Acrylate (20)/Behenyl Acrylate (80) |
| | | Melting Temperature (° C.) | 49 | 69 | 60 | 60 | 60 |
| | | Number Average Molecular Weight Mn | 19980 | 20010 | 20100 | 20300 | 20100 |
| Polyester Skeleton | | Composition (mol % in brackets) | TPA(30)/DSA(10)/FA(10)/BPAEO(25)/BPAPO(25) | TPA(30)/DSA(10)/FA(10)/BPAEO(25)/BPAPO(25) | TPA(30)/DSA(10)/FA(10)/BPAEO(25)/BPAPO(25) | TPA(30)/DSA(10)/FA(10)/BPAEO(25)/BPAPO(25) | TPA(30)/DSA(10)/FA(10)/BPAEO(25)/BPAPO(25) |
| | | Weight Average Molecular Weight | 25300 | 25300 | 25300 | 25300 | 25300 |

TABLE 1-continued

| | | Example 1 | Example 2 | Example 3 | Example 4 | Example 5 |
|---|---|---|---|---|---|---|
| Mass Ratio of Block Copolymer (block copolymer/polyester resin × 100) | | 40 | 30 | 30 | 30 | 25 |
| Characteristic Evaluation | Toner Strength | B | A | A | A | A |
| | Aggregation in Developing Mechanism | B | A | A | A | A |
| | Toner Charge Stability | A | A | A | A | A |
| | Low-Temperature Fixability | A | B | A | A | A |
| | Strength of Fixed Image | B | B | B | A | A |
| | Preservability of Fixed Image | B | A | A | A | A |
| Remarks | | | | | | |

TABLE 2

| | | | Example 6 | Example 7 |
|---|---|---|---|---|
| Polyester Resin Dispersion Kind | | | F | G |
| Block Copolymer Grafted onto Polyester Skeleton | Styrene-based Polymer Block | Monomer Kind (mass ratio in brackets) | Styrene | Styrene |
| | | Mass Ratio in Block Copolymer (% by mass) | 16.9 | 16.9 |
| | | Number Average Molecular Weight Mn | 5080 | 4900 |
| | Crystalline Acrylate-based Polymer Block | Monomer Kind (mass ratio in brackets) | Hexadecyl Acrylate | Stearyl Acrylate |
| | | Melting Temperature (° C.) | 42 | 49 |
| | | Number Average Molecular Weight Mn | 19900 | 19980 |
| Polyester Skeleton | | Composition (mol % in brackets) | TPA(30)/DSA(10)/FA(10)/BPAEO(25)/BPAPO(25) | TPA(40)/FA(10)/BPAEO(25)/BPAPO(25) |
| | | Weight Average Molecular Weight | 25300 | 25500 |
| Mass Ratio of Block Copolymer (block copolymer/polyester resin × 100) | | | 40 | 40 |
| Characteristic Evaluation | Toner Strength | | B | A |
| | Aggregation in Developing Mechanism | | B | A |
| | Toner Charge Stability | | B | A |
| | Low-Temperature Fixability | | A | B |
| | Strength of Fixed Image | | B | A |
| | Preservability of Fixed Image | | B | A |
| | Remarks | | | |

TABLE 3

| Binder Resin Composition | | Comparative Example 1 (Polyester Resin Dispersion H) Blend of Polyester Resin and Crystalline Vinyl Resin (polymer of behenyl acrylate, melting temperature = 69° C., Mn = 29980) (30% by mass of crystalline vinyl resin is blended) | Comparative Example 2 (Polyester Resin Dispersion I) Blend of Polyester Resin and Crystalline Polyester Resin (condensation polymer of 1,12-dodecane dicarboxylic acid and 1,9-nonane diol, melting temperature = 73° C., Mw = 21300) (40% by mass of crystalline polyester resin is blended) |
|---|---|---|---|
| Characteristic Evaluation | Toner Strength | C | C |
| | Aggregation in Developing Mechanism | C | C |
| | Toner Charge Stability | A | C |
| | Low-Temperature Fixability | C | A |
| | Strength of Fixed Image | C | C |
| | Preservability of Fixed Image | A | A |
| | Remarks | | |

Polyester resin = TPA (30)/DSA (10)/FA (10)/BPAEO (25)/BPAPO (25): mol % in brackets, Mw 25300

From the above results, it is found that in the examples, all of the toner strength, toner charge stability and fixed image strength are excellent in comparison to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a polyester resin comprising a graft copolymer, the graft copolymer being formed with a polyester skeleton as a main chain and block copolymers comprising a styrene-based polymer block and a crystalline acrylate-based polymer block, wherein the styrene-based polymer block is grafted onto the polyester skeleton.

2. The electrostatic charge image developing toner according to claim 1, wherein the crystalline acrylate-based polymer block is a polymer block of a monomer of at least one selected from stearyl acrylate and behenyl acrylate.

3. The electrostatic charge image developing toner according to claim 2, wherein the polyester skeleton has an unsaturated polyester component, and the styrene polymer block of the block copolymer is grafted onto the unsaturated polyester component of the polyester skeleton.

4. An electrostatic charge image developer comprising:

the electrostatic charge image developing toner according to claim 3.

5. A toner cartridge that accommodates the electrostatic charge image developing toner according to claim 3 and is detachable from an image forming apparatus.

6. An electrostatic charge image developer comprising:

the electrostatic charge image developing toner according to claim 2.

7. A toner cartridge that accommodates the electrostatic charge image developing toner according to claim 2 and is detachable from an image forming apparatus.

8. The electrostatic charge image developing toner according to claim 1, wherein the polyester skeleton has an unsaturated polyester component, and the styrene polymer block of the block copolymer is grafted onto the unsaturated polyester component of the polyester skeleton.

9. An electrostatic charge image developer comprising:

the electrostatic charge image developing toner according to claim 8.

10. A toner cartridge that accommodates the electrostatic charge image developing toner according to claim 8 and is detachable from an image forming apparatus.

11. An electrostatic charge image developer comprising:

the electrostatic charge image developing toner according to claim 1.

12. A process cartridge that is detachable from an image forming apparatus, the cartridge comprising:

a developing section that contains the electrostatic charge image developer according to claim 11 and develops an electrostatic charge image formed on an image holding member with the electrostatic charge image developer as a toner image.

13. An image forming apparatus comprising:

an image holding member;

a charging section that charges the image holding member;

an electrostatic charge image forming section that forms an electrostatic charge image on a surface of the charged image holding member;

a developing section that contains the electrostatic charge image developer according to claim 11 and develops the electrostatic charge image formed on the image holding member with the electrostatic charge image developer as a toner image;

a transfer section that transfers the toner image formed on the image holding member onto a transfer medium; and a fixing section that fixes the toner image transferred onto the transfer medium.

14. An image forming method comprising:

charging an image holding member;

forming an electrostatic charge image on a surface of the charged image holding member;

developing the electrostatic charge image formed on the image holding member with the electrostatic charge image developer according to claim 11 as a toner image;

transferring the toner image formed on the image holding member onto a transfer medium; and fixing the toner image transferred onto the transfer medium.

15. A toner cartridge that accommodates the electrostatic charge image developing toner according to claim 1 and is detachable from an image forming apparatus.

* * * * *